United States Patent [19]

Hotine

[11] 4,017,220

[45] Apr. 12, 1977

[54] REVERSIBLE PUMP WITH POSITIVE VALVING

[76] Inventor: William Hotine, Box 216, Albion, Calif. 95410

[22] Filed: Oct. 30, 1975

[21] Appl. No.: 627,381

[52] U.S. Cl. ..... 417/273; 91/476

[51] Int. Cl.[2] ..... F04B 1/04; F01B 13/06

[58] Field of Search ..... 417/270–273, 417/510, 518; 91/496, 490

[56] References Cited

UNITED STATES PATENTS

| | | | |
|---|---|---|---|
| 924,280 | 6/1909 | Sharpneck | 91/496 |
| 1,574,976 | 3/1926 | Ingram | 91/496 |
| 1,647,309 | 11/1927 | Rex | 417/273 |
| 2,461,121 | 2/1949 | Markham | 417/273 |
| 2,530,337 | 11/1950 | McGogy | 91/496 |
| 3,036,557 | 5/1962 | Kimsey | 91/490 |

*Primary Examiner*—William L. Freeh

[57] ABSTRACT

A radial three cylinder cam actuated piston pump progressively transfers fluid through each cylinder in sequence from inlet to outlet via two open ports in each cylinder head and inter connecting ducts; during one-third of a cam actuation cycle one resiliently padded piston top is actuated to dwell pressed against its cylinder head to close its ports and provide positive valving and prevention of back flow; a second similar piston is actuated to eject fluid from its cylinder; and a third similar piston is retracted to receive fluid into its cylinder; each of the three pistons is sequentially actuated in these three phases during one cam cycle to constitute a pumping cycle delivering one cylinder of fluid per cam revolution; the symetrical cam system allows reversibility of flow and prevents back flow in either direction when rotation is stopped.

6 Claims, 8 Drawing Figures

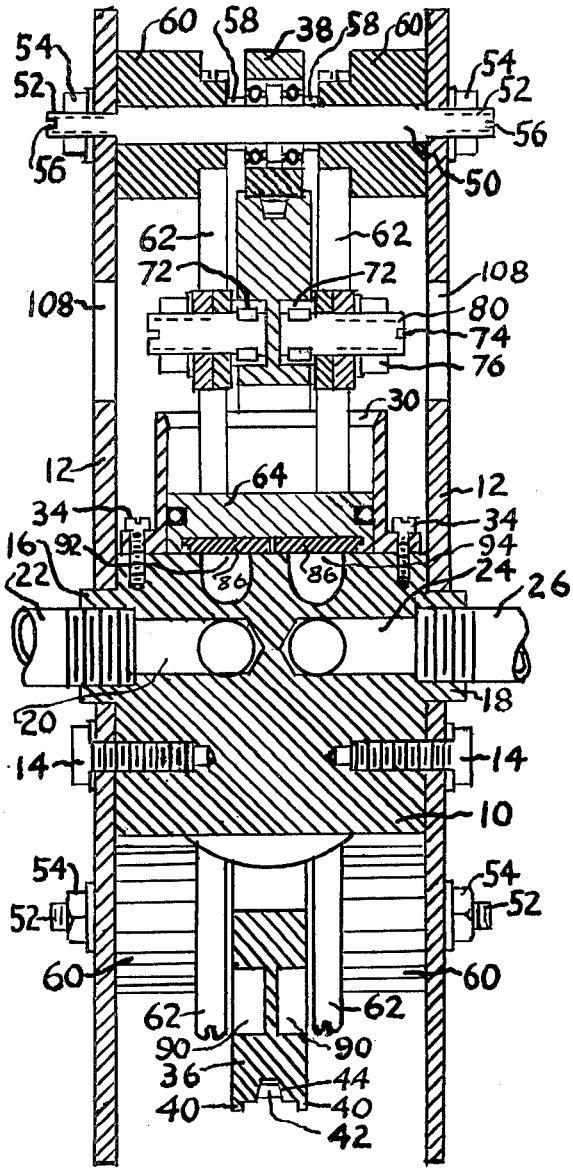
FIG. 3
FIG. 4
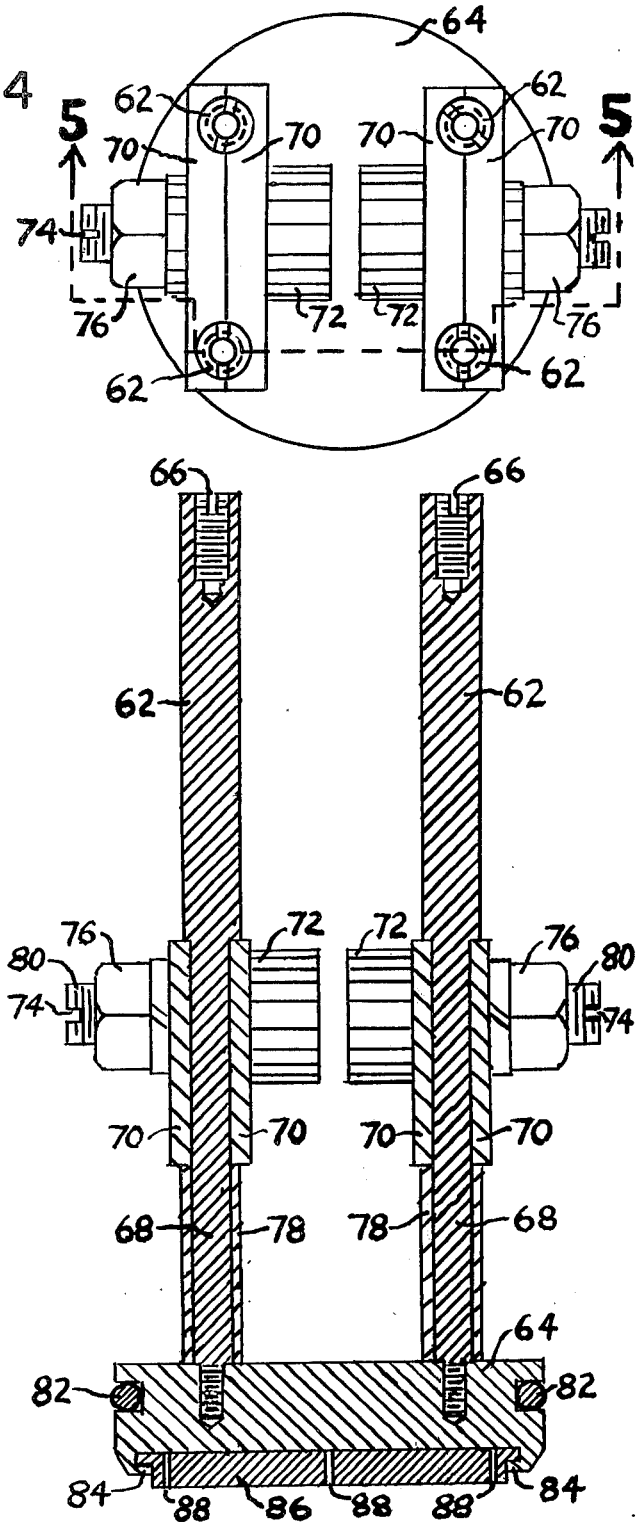
FIG. 5

REVERSIBLE PUMP WITH POSITIVE VALVING

BACKGROUND OF THE INVENTION

This invention is directed to means for providing a reciprocating piston type pump having an integral positively actuated valving mechanism enabling reversibility of flow and prevention of back flow without the use of check valves, slide valves, or rotating seals formerly required in the prior art. In the invention, the pistons function by their construction and actuation duty cycle to perform fluid intake, fluid discharge, and valve port closure in that order in three equal time phases, in contrast to prior art devices using the pistons in two equal time phases of fluid intake and fluid discharge and requiring separate inlet and discharge valves to prevent back flow. The invention thus permits dispensing with the check valves used in prior art hydraulic systems. The invention utilizes the pistons to accomplish all necessary valving in a manner not previously known by employing a resilient pad of compressible material on the piston top which is compressed between the piston and cylinder head after fluid is discharged from the cylinder. The invention provides a more reliable long wearing and positive valve closure than prior art valving devices because solid particles which may be present in the fluid and caught between the cylinder head and the piston pad are temporarily imbedded in the compressible material of the pad and do not prevent effective port closure. The invention thus permits dispensing with filters required on prior art hydraulic systems which have been subject to malfunction caused by solid particles in the fluid, and makes possible a simplified and more reliable hydraulic system. The invention employs an external annular piston drive wheel having cam slots on its sides to provide the piston actuation duty cycle by positive actuation of the cam follower equipped pistons in three cylinders radially disposed at three equal angles on a central stationary ducting and support member. In the invention each piston goes through its duty cycle in one revolution of the cam wheel, with the pistons successively phased in their duty cycles by the equal angular and symmetrical rise and fall portions on each side of the equal angular constant dwell portion of the cam. The invention thus permits a reversal of flow through the pump by a reversal of direction of cam wheel rotation while maintaining the same piston duty cycle but in reverse order of piston actuation. The invention permits dispensing with separate check valves formerly required with prior art devices when at rest because one piston is always positively locked in its port closed position by the dwell portion of the cam whether the cam is rotating or at rest thus always preventing any back flow through the pump. In the invention, fluid enters and leaves each cylinder via large cylinder head ports, impelled by the piston motion. The invention uses short direct constant diameter ducts and ports in a central stationary ducting member having no seals, thus providing higher efficiency and reliability than prior art devices requiring flow restricting separate valves or rotary seals. As the piston pad of the present invention has no sliding or rotating motion against its seat on the cylinder head and has a large area of contact, wear is minimized in comparison to prior art valving devices. The only moving seals used in the invention are the O-Rings on the reciprocating pistons. Due to the short cam driven piston stroke of the invention, the life of the O-Rings is comparatively long. In the invention, the employment of an external annular cam wheel and sealed ball bearings make possible the quick and easy disassembly of the pump for repair purposes and simple bearing renewal in contrast to prior art devices.

SUMMARY OF THE INVENTION

The invention is a reciprocating piston type of lift and force pump in which three cylinders are radially disposed at equal angles around a fixed central ducting and support member with the pistons externally actuated by a surrounding annular cam wheel. The cam wheel rotates on peripheral rollers mounted on side plates attached to the fixed central support member and is driven by a belt. The pistons are provided with radial alignment guides carrying anti-friction bearing cam followers fitting into identical cam slots on each side of the cam wheel. The piston seals are O-Rings, and the piston top is covered by a resilient synthetic rubber pad retained in a circumferential slotted shoulder. The central fixed ducting member is provided with short, direct large diameter ducts to convey fluid from the inlet on one lateral side through the cylinders in serial sequence to the outlet on the other side, the fluid entering and leaving each succeeding cylinder through two large diameter ports in each cylinder head. The inlet duct connects with a port on the first cylinder, the other port of the first cylinder connects with a port on the second cylinder, the other port of the second cylinder connects with a port on the third cylinder, and the other port of the third cylinder connects with the outlet duct. As the cam wheel rotates, each piston is positively cam actuated in three equal time periods or phases to retract and receive fluid into its cylinder, to pump and expel fluid from its cylinder, and then to dwell closed to act as a valve, preventing fluid passage between its two cylinder head ports by compressing the resilient piston pad between the piston top and the cylinder head. The cam groove has symmetrical rise and fall portions on each side of a constant radius dwell portion, in equal angular segments for the three equal periods of the piston duty cycle, with the duty cycle of each piston differing in phase by one third of a cam revolution. In the first one-third of cam revolution, assuming the second piston to be in dwell closed position acting as a valve, the simultaneous rise of the first piston creates a vacuum in the first cylinder drawing fluid into it from the inlet, while the simultaneous fall of the third piston pumps fluid through the outlet. In the second one-third of cam revolution, the third piston is in dwell closed position acting as a valve so that the simultaneous rise of the second piston creates a vacuum in the second cylinder and the simultaneous fall of the first piston expels fluid from the first cylinder, this fluid being drawn to the second cylinder by the vacuum there even though the inlet port of the first cylinder is open. In the final one-third of a cam revolution, the first piston is in dwell closed position acting as a valve, so that the simultaneous rise of the third piston draws fluid into the third cylinder, this fluid being expelled from the second cylinder by the simultaneous fall of the second piston. The above described sequence of events completes a pumping cycle with one revolution of the cam, and is reversed in order if the cam is reversed in direction or rotation; the former outlet becomes the inlet and fluid flow progresses from it through the third cylinder to the second cylinder to the first cylinder and then out of the former inlet. The invention thus enables pumping in either direction with the pistons performing identical valving functions as they are held in the closed port dwell position by the constant radius dwell portion of the cam. As one piston of the three is always positively locked by the cam slot in closed port dwell position there can be no flow through the pump when rotation of the cam ceases. The invention thus enables dispensing with external valves. External actuation of the pistons enables easy and quick disassembly for renewal of worn parts. Absence of rotating seals or check valves results in simplicity, reliability and economy.

Thus, it is an object of this invention to provide an improved piston type pump utilizing the novel construction and duty cycle of the pistons to perform all necessary valving functions.

Another object of the invention is to provide a long wearing piston valve construction not susceptible to damage or malfunction caused by solid particles contained in the pumped fluid.

Another object of the invention is to provide an improved pump having positive valving and capable of reversal of direction of pumping flow by reversal of drive direction.

Still another object of the invention is to provide an improved pump through which no flow can take place when the pump is stopped.

Yet another object of the invention is to provide an improved pump having simplified construction enabling easy disassembly for repair.

These objects and features of the invention and the construction of the invention can be understood from the accompanying drawings and following written description.

BRIEF DESCRIPTION OF THE DRAWINGS

FIG. 3 is a cross-sectional view along the lines 3—3 in FIG. 1.

FIG. 4 is an enlarged plan view of a piston of the invention.

FIG. 5 is a cross-sectional view along the lines 5—5 in FIG. 4, showing pad of resilient material on top of piston and piston guides and cam followers.

DESCRIPTION OF THE PREFERRED EMBODIMENT

Figure 2:
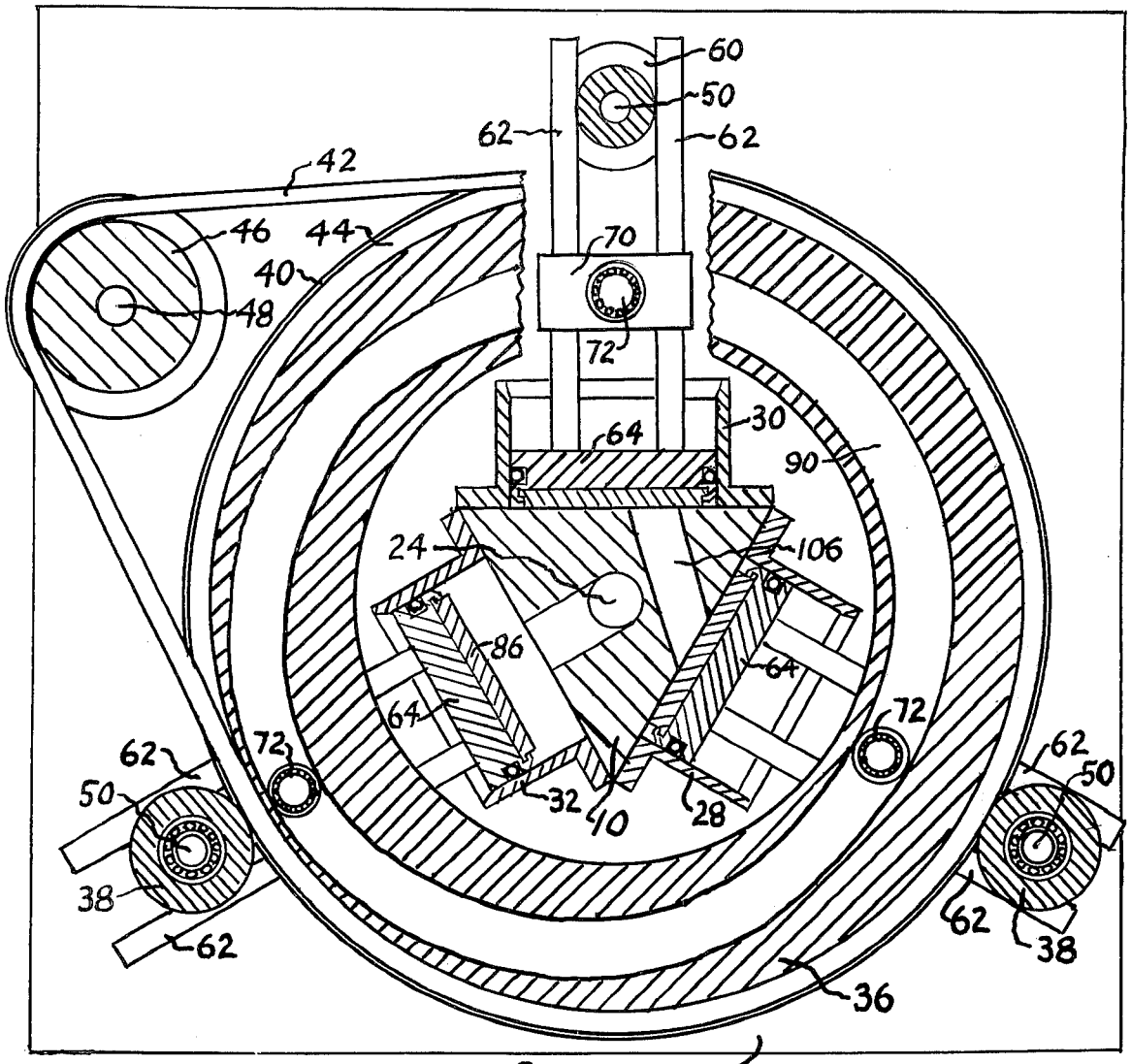
FIG. 2 is a cross-sectional view along the lines 2—2 in FIG. 1, partly broken away.
Figure 1:
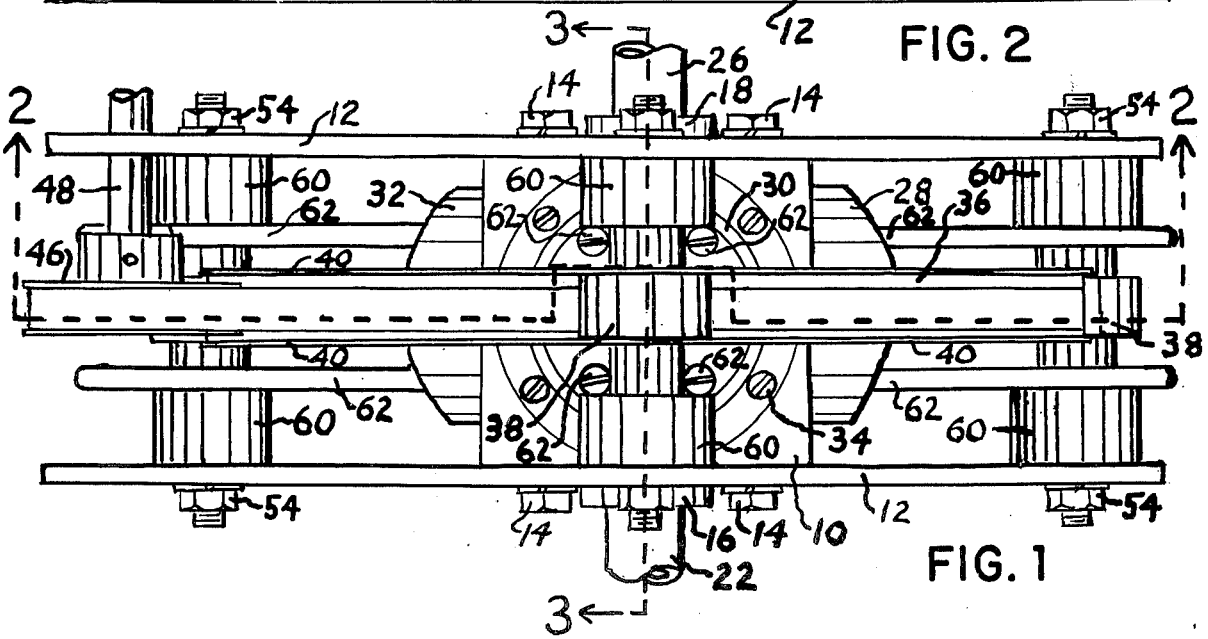
FIG. 1 is a side view of the pump, in elevation.

Referring to the drawings and particularly to FIGS. 1 and 2, a triangular central ducting and support member 10 carries the two flat side plates 12. The side plates 12 are secured to ducting member 10 by bolts 14, and are centrally located accurately by shoulders 16 and 18 which project from ducting member 10. Referring to FIG. 3, the inlet duct 20 enters shoulder 16 and is tapped for inlet pipe 22, while the outlet duct 24 exits through shoulder 18 and is tapped for outlet pipe 26. Referring to FIG. 2, the three flat faces of the triangular member 10 form the cylinder heads for the three attached cylinders 28, 30 and 32 which are fastened by screws 34 to member 10. Surrounding the three cylinders, an annular cam wheel 36 is rotatably supported on its flat periphery by three ball bearing rollers 38. The wheel 36 has guiding shoulders 40 on each side of its flat periphery and is driven by belt 42 which fits into the central sheave slot 44. Belt 42 is driven by pulley 46 and rotation of drive shaft 48 by a source of rotary power not shown. Referring to FIG. 3, the ball bearing rollers 38 are supported by shafts 50 extending between side plates 12. The shafts 50 are made with threaded ends 52 and are locked in position by nuts 54. Each end of shaft 50 is made slightly eccentric to the center bearing portion, and is provided with a screw driver slot 56 for adjustment of the radial distance of roller 38 from the center of ducting member 10, for adjustment of play between the three rollers 38 and the outside of cam wheel 36. Rollers 38 are centrally located on shaft 50 by spacers 58 and guide blocks 60 which serve the double purpose of also radially aligning the four piston guide rods 62 which screw into each piston 64. Referring to FIGS. 4 and 5, each guide rod 62 is provided with a screw driver slot 66 at its upper end and a screw portion at its lower end fitting a threaded hole in the piston, and has a lower portion 68 of reduced diameter to fit cam follower mounting blocks 70. The split cam follower mounting blocks 70 are bored to clamp around portion 68 of two guide rods, tightened by the cam follower mounting studs 80 and nuts 76. The studs 80 are slightly eccentric to the cam followers 72 and provide adjustment of cam follower radial position by rotation of stud 80 with a screw driver using the slots 74 in the ends of stud 80 before tightening nuts 76. The tubular spacers 78 fit loosely on portions 68 of the guide rods 62 and establish the distance between the bottom of the piston 64 and the bottom of the cam follower blocks 70. The guide rods 62 are tapped on their outer end to fit screws in a handle which can be used during disassembly of the pump for easy pulling of the piston from its cylinder.

The piston 64 is provided with a circumferential slot fitting O-Ring 82, and has a recessed top with a circumferential lip 84 which retains the resilient piston pad 86. The pad 86 may be made of neoprene or other suitable resilient compressible material, and has a number of small perforations 88 to prevent accumulation of fluid in back of the pad, which would distend the pad from the piston top.

Referring to FIG. 3, the cam followers 72 fit into the cam slots 90 on each side of cam wheel 36. Referring to FIG. 2, the cam slot 90 has a constant radius portion between the angle of cylinders 28 and 30, a falling portion between the angle of cylinders 30 and 32, and a rising portion between cylinders 32 and 28. Rotation of the cam wheel 120°, for example, in a counter clockwise direction, as viewed in FIG. 2, will retract the piston in cylinder 28, lock the piston top against the cylinder head in cylinder 30, and drive down the piston in cylinder 32 pumping its contents through outlet pipe 26.

Figure 6:
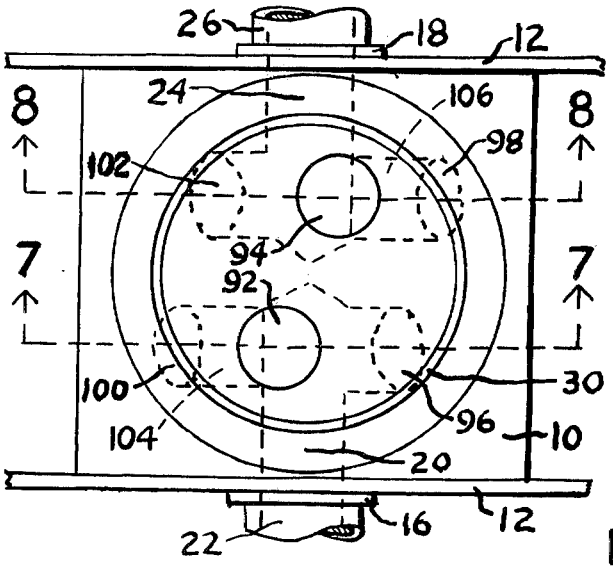
FIG. 6 is a fragmentary side view of the central ducting member with ducts shown by dotted lines and other components omitted for clarity.
Figure 7:
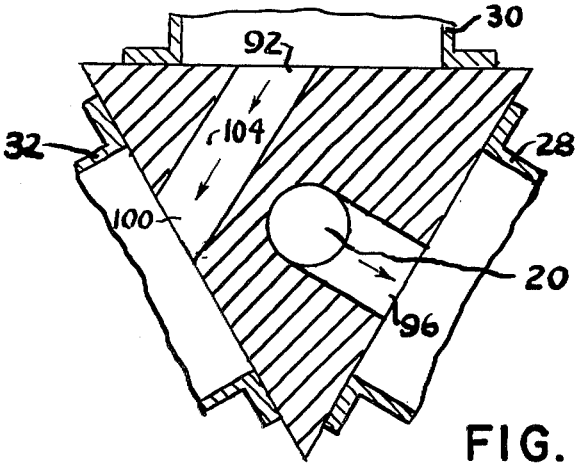
FIG. 7 is a fragmentary cross-sectional view along the lines 7—7 in FIG. 6.
Figure 8:
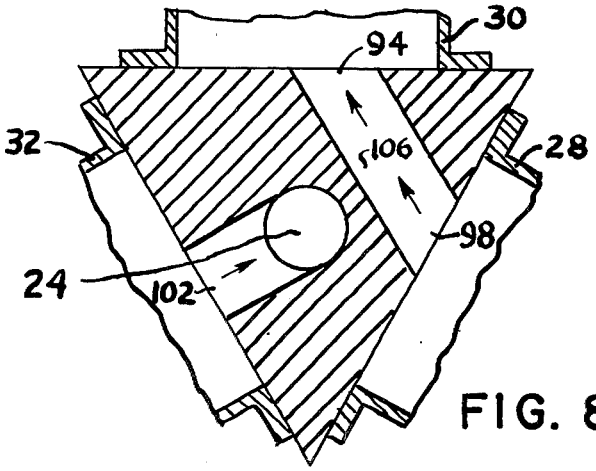
FIG. 8 is a fragmentary cross-sectional view along the lines 8—8 in FIG. 6.

FIGS. 6, 7 and 8 illustrate the ducts and ports of member 10. The inlet pipe 22 is connected to the inlet duct 20 which makes a 90° turn, as shown in FIG. 7, and connects with an inlet port 96 for cylinder 28. An outlet port 98 for cylinder 28 is connected through an internal duct 106 to an inlet port 94 for cylinder 30. An outlet port 92 for cylinder 30 is connected through an internal duct 104 to an inlet port 100 for cylinder 32. An outlet port 102 for cylinder 32 is connected to the outlet duct 24 which makes a 90° turn, as shown in FIG.

8, and then connects to the outlet pipe 26. Directional arrows are included in FIGS. 7 and 8 to show the direction of fluid flow for the operational example described herein below.

Referring again to FIGS. 6, 7, and 8, the above described exemplary 120° rotation of the cam wheel will close the cylinder head ports for cylinder 30, that is, outlet port 92 and inlet port 94, preventing fluid flow through cylinder 30, will pump fluid through outlet port 102 for cylinder 32 and outlet duct 24 to outlet pipe 26, and will inject fluid through inlet port 96 into cylinder 28 via inlet pipe 22 and inlet duct 20 because of the vacuum created in cylinder 28. Fluid cannot pass through internal ducts 104 and 106 because ports 92 and 94 for cylinder 30 are closed by the valving action of the piston pad 86 pressing against the head of cylinder 30. During the next 120° rotation of the cam wheel, inlet port 100 and outlet port 102 for cylinder 32 are closed by the valving action of the piston in cylinder 32 preventing flow through cylinder 32, and fluid is transferred from cylinder 28 to cylinder 30 through outlet port 98 of cylinder 28 because of the vacuum in cylinder 30, the fluid moving through duct 106 and inlet port 94 for cylinder 30 as the piston in cylinder 30 simultaneously retracts with the driving in of the piston in cylinder 28. During the final 120° of cam wheel rotation, inlet port 96 and outlet port 98 for cylinder 28 are closed by the valving action of the piston in cylinder 28, preventing flow through cylinder 28, and fluid is transferred from cylinder 30 to cylinder 32 by the vacuum in cylinder 32, the fluid moving through outlet port 92 for cylinder 30, duct 104, and inlet port 100 for cylinder 32 as the piston in cylinder 32 simultaneously retracts with the driving in of the piston in cylinder 30. Cylinder 32 is therefore filled with fluid for repeating the pumping cycle of operation during the next 360° rotation of the cam wheel. The rising and falling portions of the cam slot 90 have identical slopes, so that reversal of the cam wheel direction of rotation causes a reverse sequence of operations in which the former outlet 26 becomes the inlet, and the fluid progresses through cylinders 32, 30, and 28 to former inlet 22 which becomes the outlet. As one of the three pistons is always locked in closed port position by the constant radius portion of the cam, flow through the pump can take place only when the cam wheel is rotated, and then only in the proper direction. External valving necessary to provide this type of operation with pumps of the previous art can be dispensed with when using the invention.

Referring to FIG. 3, the piston of cylinder 30 is shown in the port closed position in which the constant radius portion of the cam compresses the resilient pad 86 between the piston 64 and the head of cylinder 30 closing ports 92 and 94. The access holes 108 in each side plate 12 allow adjustment of the eccentric stud 80 of the cam follower 72 by screw driver slot 74 to provide the proper degree of compression of pad 86. The circular pad 86 overlaps the ports and fills the area between them, to provide a positive pressure seal of the ports. The material of the pad 86 is chosen for the particular application of the pump. It can be seen that small solid particles contained in the fluid will imbed themselves temporarily in a very small area of the surface of pad 86, therefore not affecting the pressure seal which closes the two ports of a cylinder. A ridge around the circumference of pad 86 fits into a slot under lip 84 to provide a simple and effective fastening of the pad 86 to the bottom of piston 64. The pad can be easily removed by prying one side out with a screw driver, similarly to the removal of the O-Ring. The invention has been designed for easy and quick maintenance. Bolts 14 and nuts 54 are removed from one side plate 12, nuts 76 are loosened, and cam follower mounting blocks and cam followers are removed, together with cam wheel 36. Pistons are removed by pulling on guide rods 62. Assembly procedure is the reverse of the above. As the antifriction bearing components are sealed with contained lubricating grease, bearing lubrication problems are minimized and contamination is prevented. It can be seen that the larger diameter ducts and ports of the invention enable good hydraulic efficiency.

While the preferred embodiment of the invention has been described, other mechanical configurations are possible which may employ the above described operating principles of the three cylinder, three phase cam driven reversible pump of the invention. In these configurations, diaphragms can be mechanically equivalent to pistons, and can also serve to close cylinder ports in the manner of the invention. Therefore, the form of the invention described should be considered as illustrative and not as limiting the scope of the following claims.

I claim:

1. A fluid pumping device comprising:

a plurality of mounting plates;

a ducting and support member substantially centrally secured within said mounting plates and containing an inlet duct, an outlet duct and a plurality of internal ducts;

a plurality of flat face portions formed on said member defining a plurality of cylinder heads, each of said cylinder heads having an inlet port and an outlet port, said inlet and outlet ports of each of said cylinder heads interconnecting with said internal ducts to permit the flow of fluid through said inlet and outlet ports of each of said cylinder heads in sequence from said inlet duct to said outlet duct;

a cylinder affixed to each of said cylinder heads, each of said cylinders enclosing said inlet and outlet ports of an associated cylinder head;

a reciprocating piston slidably positioned in each of said cylinders, each of said pistons having a top surface and a bottom surface;

a resilient sealing pad affixed to the bottom surface of each of said pistons;

a plurality of alignment guide rods secured to the top surface of each of said pistons, said alignment guide rods for each of said pistons holding cam follower means;

a plurality of rotatable bearings mounted within said mounting plates near the outer perimeters thereof;

a cam wheel surrounding said ducting and support member and operably positioned within said mounting plates for rotation about an axis, said cam wheel engaging said bearings and said cam follower means to sequentially cam actuate each of said pistons in equal time periods to sequentially receive fluid into each of said cylinders through said inlet port of each of said cylinder heads, to sequentially expel fluid from each of said cylinders through said outlet port of each of said cylinder heads, and to sequentially dwell closed to act as a valve to prevent passage of fluid through said inlet and outlet ports of each of said cylinder heads by compressing said resilient piston pad over said inlet and outlet ports; and drive means connected to rotate said cam wheel about said axis, whereby fluid is pumped from said inlet duct to said outlet duct upon rotation of said cam wheel.

2. The fluid pumping device defined in claim 1, wherein said support member is triangular.

3. The fluid pumping device defined in claim 1, wherein said cylinders are radially disposed at equal angles around said support member.

4. The fluid pumping device defined in claim 1, wherein said bearings are ball bearing rollers.

5. The fluid pumping device defined in claim 1, including cam follower adjustment means connected to said cam follower means for adjusting the radial position of said cam follower means to provide the desired degree of compression for said port sealing means.

6. The fluid pumping device defined in claim 1, including bearing adjustment means connected to said bearings for adjusting the radial distance of said bearings from the center of said support member, thus adjusting the play between said bearings and said cam wheel.

* * * * *